US006011945A

United States Patent [19]

Kim

[11] Patent Number: 6,011,945

[45] Date of Patent: Jan. 4, 2000

[54] ELECTROPHOTOGRAPHIC PRINTER FOR PRINTING DUPLEX IMAGES

[75] Inventor: Yong-soo Kim, Yongin, Rep. of Korea

[73] Assignee: Samsung Electronics Co., Ltd., Kyungki-do, Rep. of Korea

[21] Appl. No.: 08/917,680

[22] Filed: Aug. 26, 1997

[30] Foreign Application Priority Data

Sep. 13, 1996 [KR] Rep. of Korea ..... 96-39846

[51] Int. Cl.[7] ..... G03G 15/16

[52] U.S. Cl. ..... 399/309

[58] Field of Search ..... 399/309, 308, 399/302, 300

[56] References Cited

U.S. PATENT DOCUMENTS

| | | | |
|---|---|---|---|
| 4,674,857 | 6/1987 | Satomura et al. | 399/306 |
| 4,688,925 | 8/1987 | Randall | 399/309 |
| 4,714,939 | 12/1987 | Ahern et al. | 399/309 |
| 5,070,371 | 12/1991 | Randall | 399/302 |
| 5,138,389 | 8/1992 | Randall | 399/302 |
| 5,410,392 | 4/1995 | Landa | 399/308 |
| 5,420,662 | 5/1995 | Gerstner | 355/23 |
| 5,561,510 | 10/1996 | Kamp et al. | 399/308 |

FOREIGN PATENT DOCUMENTS

| | | |
|---|---|---|
| 0 609 966 A2 | 8/1994 | European Pat. Off. . |
| 3-167580 | 7/1991 | Japan . |
| 4-163562 | 6/1992 | Japan . |
| 7-500925 | 1/1995 | Japan . |
| WO 93/08511 | 4/1993 | WIPO . |

*Primary Examiner*—Robert Beatty

*Attorney, Agent, or Firm*—Sughrue, Mion, Zinn, Macpeak & Seas, PLLC

[57] ABSTRACT

An electrophotographic printer includes a photosensitive drum sensitized with first and second images to be printed and a sheet-feeding roller for supplying a sheet on which the images are printed. The photosensitive drum is sensitized by the first image for one side and the second image for the other side to be printed. The electrophotographic printer is comprised of first and second transfer rollers. The first transfer roller transfers and prints the first image, which is sensitized on the photosensitive drum, onto the one side of the sheet as the first transfer roller rotates while contacting the photosensitive drum. The second transfer roller transfers and prints the second image, which is sensitized on the photosensitive drum and transferred to the second transfer roller via the first transfer roller, onto the other side of the sheet as the second transfer roller rotates while contacting first transfer roller. The second transfer roller has a circumference equal to the total length of the sheet plus one half the circumference of the first transfer roller.

2 Claims, 1 Drawing Sheet

ELECTROPHOTOGRAPHIC PRINTER FOR PRINTING DUPLEX IMAGES

BACKGROUND OF THE INVENTION

The present invention relates to an electrophotographic printer and, more particularly, to an electrophotographic printer capable of printing both sides of a print sheet.

In general, a typical electrophotographic printer such as a laser printer includes a rotary mirror reflecting a laser beam toward a photosensitive drum while rotating at high speed, a sheet-feeding roller which supplies sheets toward the photosensitive drum, a press roller which presses the supplied sheet together with the photosensitive drum to allow the sheet to pass therebetween, and an expelling roller which expels the sheet after printing. An image reflected from the rotary mirror is transferred to one side of the sheet supplied by the photosensitive drum.

In the above conventional electrophotographic printer, an image is printed on only one side of a sheet. Thus, to print both sides of the sheet, a sheet of which one side already has been printed must be re-supplied to print the other side of the sheet which makes two-side printing work burdensome and prolongs working hours.

SUMMARY OF THE INVENTION

To overcome the above problems, it is an object of the present invention to provide an electrophotographic printer which enables printing on both sides (i.e., front and rear sides) of a sheet by supplying a sheet once.

Accordingly, to achieve the above object, there is provided an electrophotographic printer including a photosensitive drum sensitized with first and second images to be printed and a sheet-feeding roller for supplying a sheet on which the images are printed, in which the photosensitive drum is sensitized by the first image for one side and the second image for the other side to be printed and the electrophotographic printer comprises a first transfer roller for transferring and printing the first image, which is sensitized on the photosensitive drum, onto the one side of the sheet as the first transfer roller rotates while contacting the photosensitive drum, and a second transfer roller for transferring and printing the second image, which is sensitized on the photosensitive drum and transferred to the second transfer roller via the first transfer roller, onto the other side of the sheet as the second transfer roller rotates while contacting first transfer roller.

The circumference of the second transfer roller equals a total length of the sheet plus one half the circumference of the first transfer roller, and the sheet is supplied between the first and the second transfer rollers by the sheet-feeding roller after the second image for the other side on the photosensitive drum is transferred to the second transfer roller via the first transfer roller, so that the second image for the other side on the second transfer roller is printed on the other side of the sheet and simultaneously the first image for the one side on the photosensitive drum is printed on the one side of the sheet via the first transfer roller.

Also, it is preferable in the present invention that the circumference of the photosensitive drum is equal to or greater than the total length of two times the length of the sheet plus one half the circumference of the first transfer roller.

BRIEF DESCRIPTION OF THE DRAWINGS

The above objective and advantages of the present invention will become more apparent by describing in detail a preferred embodiment thereof with reference to the accompanying drawings, in which.

DETAILED DESCRIPTION OF THE INVENTION

Figure 1:
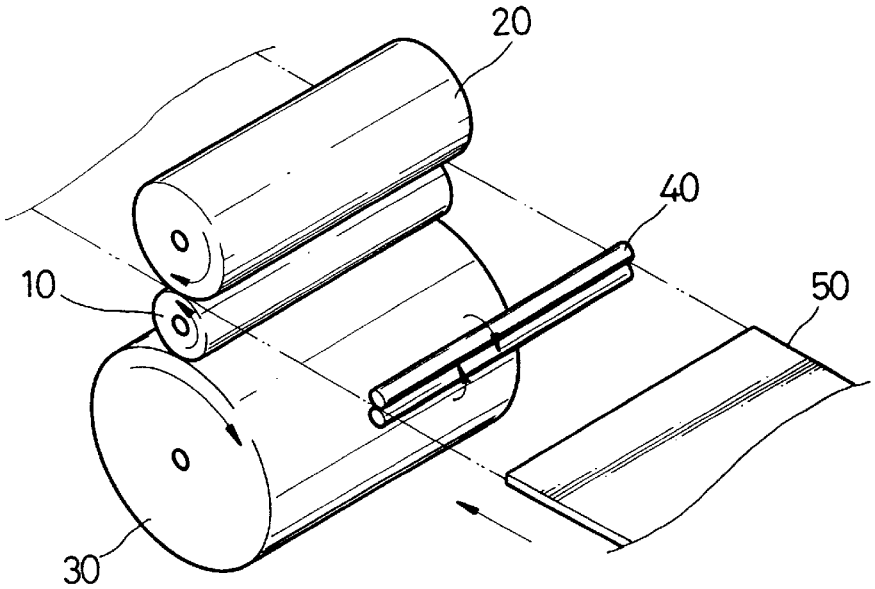
FIG. 1 is a perspective view schematically illustrating the main portion of an electrophotographic printer according to the present invention.
Figure 2:
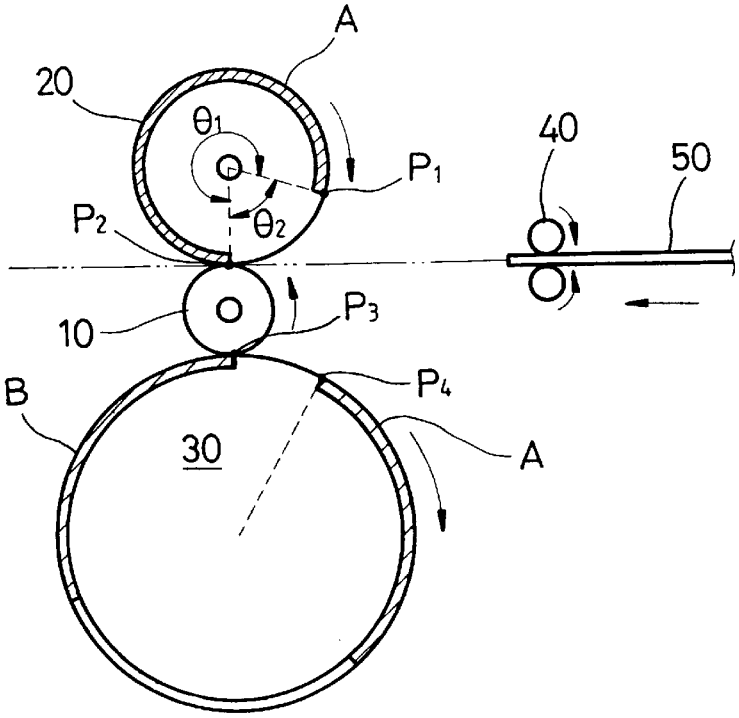
FIG. 2 is a side view of the portion shown in FIG. 1.

FIGS. 1 and 2 show the structure of the electrophotographic printer according to the present invention. As shown in the drawings, the electrophotographic printer of the present invention includes first and second transfer rollers 10 and 20 which are engaged with each other and which rotate in such a direction so as to feed a sheet which is supplied thereto, and a photosensitive drum 30 installed thereunder to contact the first transfer roller 10.

The outer circumferential surface of the photosensitive drum 30 is sensitized by a laser beam reflected from a rotary mirror (not shown) so that an image to be printed is delivered to the first and second transfer rollers 10 and 20. Reference numeral 40 indicates a sheet-feeding roller which supplies a sheet 50 toward the first and second transfer rollers 10 and 20.

According to the present invention, the circumference of the second transfer roller 20 is the same as the total length of the length of the sheet 50 supplied plus one half of the circumference of the first transfer roller 10. That is, the circumference of the second transfer roller can be represented as follows:

circumference of second transfer roller=length of sheet+½(circumference of first transfer roller)

The circumference of the photosensitive drum 30 is equal to or greater than the total length of two times the length of the sheet 50 supplied plus one half of the circumference of the first transfer roller 10. That is the circumference of the photosensitive drum can be represented as follows:

length of circumference of photosensitive drum≧2(length of sheet)+½(length of circumference of first transfer roller)

The size of the sheet may be, for example, A3, A4, A5, letter, or legal.

The electrophotographic printer having such a structure according to the present invention operates as follows.

Referring to FIG. 2, an image (A) to be printed on the front side of a sheet is recorded on a surface of the photosensitive drum 30. The image (A) is transferred to the second transfer roller 20 via the first transfer roller 10 contacting each other while rotating. Thus, the front side image (A) is recorded in an area from a point P1 to a point P2 on the second transfer roller 20, i.e., an area corresponding to angle (θ1).

Next, an image (B) to be printed on the rear side of the sheet is recorded on the photosensitive drum 30 being spaced a predetermined distance from the front side image (A) while the photosensitive drum 30 rotates. In this case, the distance between the front side image (A) and the rear side image (B), i.e, between a point P3 and a point P4, corresponds to one half the circumference of the first transfer roller 10. Also, the distance between P1 and P2 corresponding to an angle θ2 of the second transfer roller 20 is equal to one half the circumference of the first transfer roller 10.

Accordingly, the moment when the transfer of the front side image (A) to the second transfer roller 20 is completed, the transfer of the rear side image (B) to the first transfer roller 10 starts. At this stage, as described above, since the distance between P1 and P2 on the second transfer roller 20 corresponding to the angle θ2 which equals one half the circumference of the first transfer roller 10, P3 on the first transfer roller 10 and the P1 on the second transfer roller 20 meets as the first and second transfer rollers 10 and 20 rotate.

Shortly before P3 and P1 of the first and second transfer rollers 10 and 20 meet, the sheet 50 is supplied between the first and second transfer rollers 10 and 20 by rotating the sheet-feeding rollers 40. Thus, the front side image (A) recorded on the second transfer roller 20 is printed on the front side of the sheet 50 and simultaneously the rear side image (B) recorded on the photosensitive drum 30 is printed on the rear side of the sheet 50 by means of the first transfer roller 10.

As a result, the front and rear images (A and B) can be printed on the front and rear sides of a sheet, respectively, at the same time with one supply of the sheet.

Although the photosensitive drum 30 is used as a sensitizing means in the present embodiment, a sensitizing belt such as an OPC-belt which circulates in a predetermined path can be employed.

As described above, according to the electrophotographic printer of the present invention, images to be printed can be simultaneously printed on the front and rear sides of a sheet by supplying the sheet once.

It is contemplated that numerous modifications may be made to the electrophotographic printer of the present invention without departing from the spirit and scope of the invention as defined in the following claims.

What is claimed is:

1. An electrophotographic printer comprising:

a photosensitive drum sensitized with a first image and a second image to be printed respectively on one side and the other side of a sheet;

a first transfer roller for transferring the first image from said photosensitive drum to the one side of the sheet as said first transfer roller rotates while contacting said photosensitive drum;

a second transfer roller for transferring the second image, which is transferred from said photosensitive drum to said second transfer roller via said first transfer roller, to the other side of the sheet; and a sheet-feeding roller for supplying the sheet into a nip defined between said first and said second transfer rollers;

wherein said first and said second transfer rollers continuously define the nip during the transfer of the first and the second images from said photosensitive drum to the sheet;

wherein said second transfer roller has a circumference which equals a total length of the sheet plus one half a circumference of said first transfer roller;

wherein the sheet is supplied into the nip defined between said first and said second transfer rollers by said sheet-feeding roller after the second image for the other side on said photosensitive drum is transferred to said second transfer roller via said first transfer roller, so that the second image for the other side on said second transfer roller is transferred to the other side of the sheet and simultaneously the first image for the one side on said photosensitive drum is transferred to the one side of the sheet via said first transfer roller; and wherein the size of the sheet is selected from the group consisting of A3, A4, A5, legal, and letter.

2. The electrophotographic printer as claimed in claim 1, wherein said photosensitive drum has a circumference which is equal to or greater than the total length of two times the length of the sheet plus one half the circumference of said first transfer roller.

* * * * *